6/10/86 OR 4,593,627

United States Patent [19]

Lankard et al.

[11] Patent Number: 4,593,627

[45] Date of Patent: Jun. 10, 1986

[54] BURGLARY ATTACK RESISTANT MONEY SAFE HIGH FIBER CONCRETE REINFORCED METAL ENCASED WALL AND DOOR CONSTRUCTION AND MANUFACTURE

[75] Inventors: David R. Lankard, Columbus; James D. Shoop, Canton, both of Ohio

[73] Assignee: Diebold, Incorporated, Canton, Ohio

[21] Appl. No.: 497,824

[22] Filed: May 25, 1983

[51] Int. Cl.[3] ..... E04B 2/02

[52] U.S. Cl. ..... 109/83; 109/76; 106/99

[58] Field of Search ..... 109/80–84, 109/1 S, 74, 76; 106/85, 86, 89, 99, 97; 52/743

[56] References Cited

U.S. PATENT DOCUMENTS

| | | | |
|---|---|---|---|
| 3,110,271 | 11/1963 | Graber | 109/74 |
| 3,123,025 | 3/1964 | Fugelstad | 109/83 |
| 3,366,720 | 1/1968 | Burger | 106/97 |
| 4,048,926 | 9/1977 | Brush, Jr. et al. | 109/83 |
| 4,339,289 | 7/1982 | Lankard | 427/136 |
| 4,366,255 | 12/1982 | Lankard | 106/85 |
| 4,369,717 | 1/1983 | Bollier | 109/82 |
| 4,377,977 | 3/1983 | Wurster | 109/83 |

OTHER PUBLICATIONS

Handbook of Concrete Engineering, Second Edition, 1985, portions copyrighted 1974, Van Nostrand Reinhold Co., Inc., pp. 708–733.

*Primary Examiner*—Gary L. Smith
*Assistant Examiner*—Neill Wilson
*Attorney, Agent, or Firm*—Ralph E. Jocke

[57] ABSTRACT

A metal encased concrete barrier for the walls of the bodies and doors of safes or vaults having new formulations of particular metal fiber and ceramic aggregate reinforcing constituents is described which provides enhanced burglary attack resistance for money safes or vaults. New procedures also are described for casting the Portland Cement, steel fiber, and fractured fused alumina aggregate phases or constituents of the protective barrier, copper members being cooperatively integrated in the barrier.

13 Claims, 20 Drawing Figures

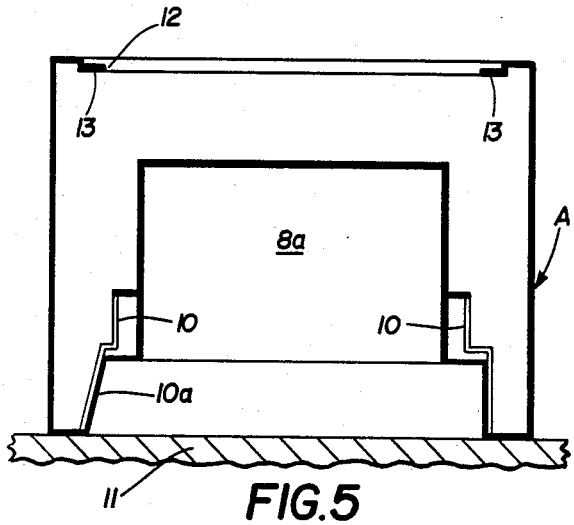
FIG.5
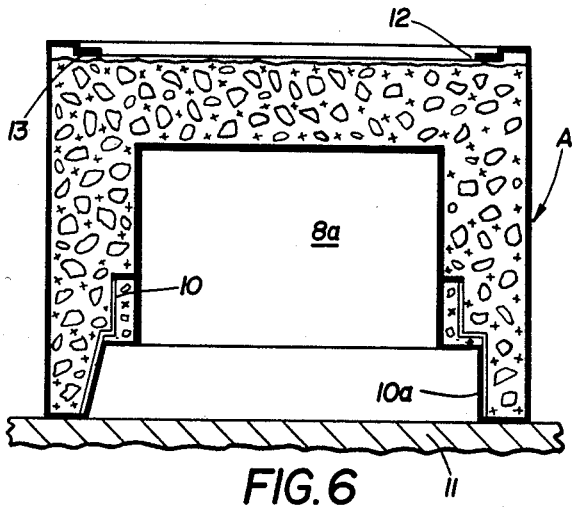
FIG.6
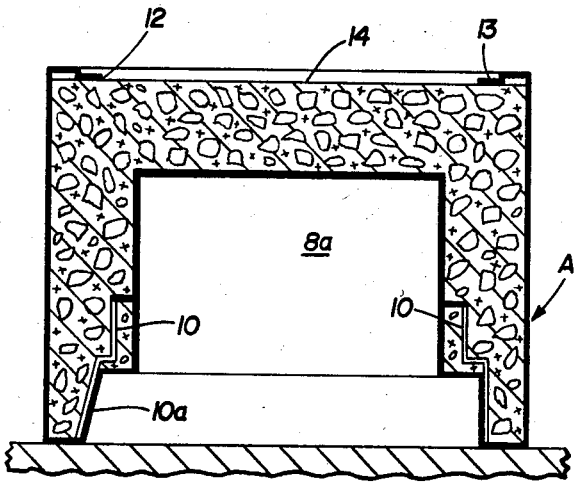
FIG.7
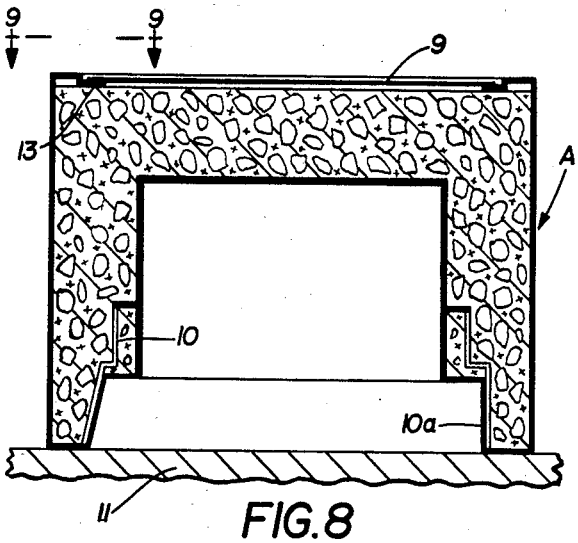
FIG.8
FIG.1
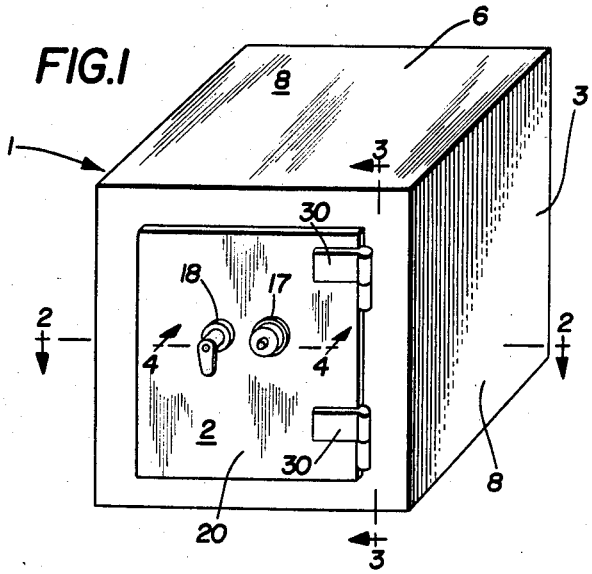
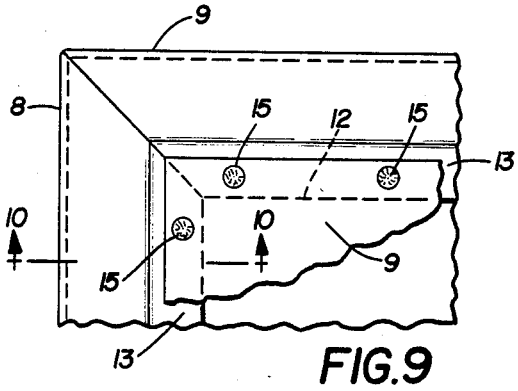
FIG.9
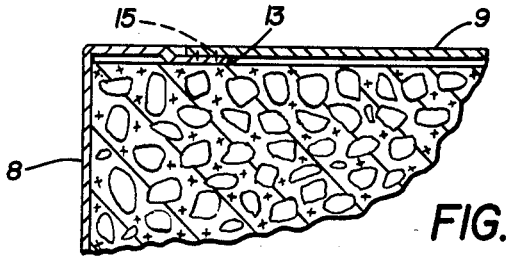
FIG.10

FIG.15
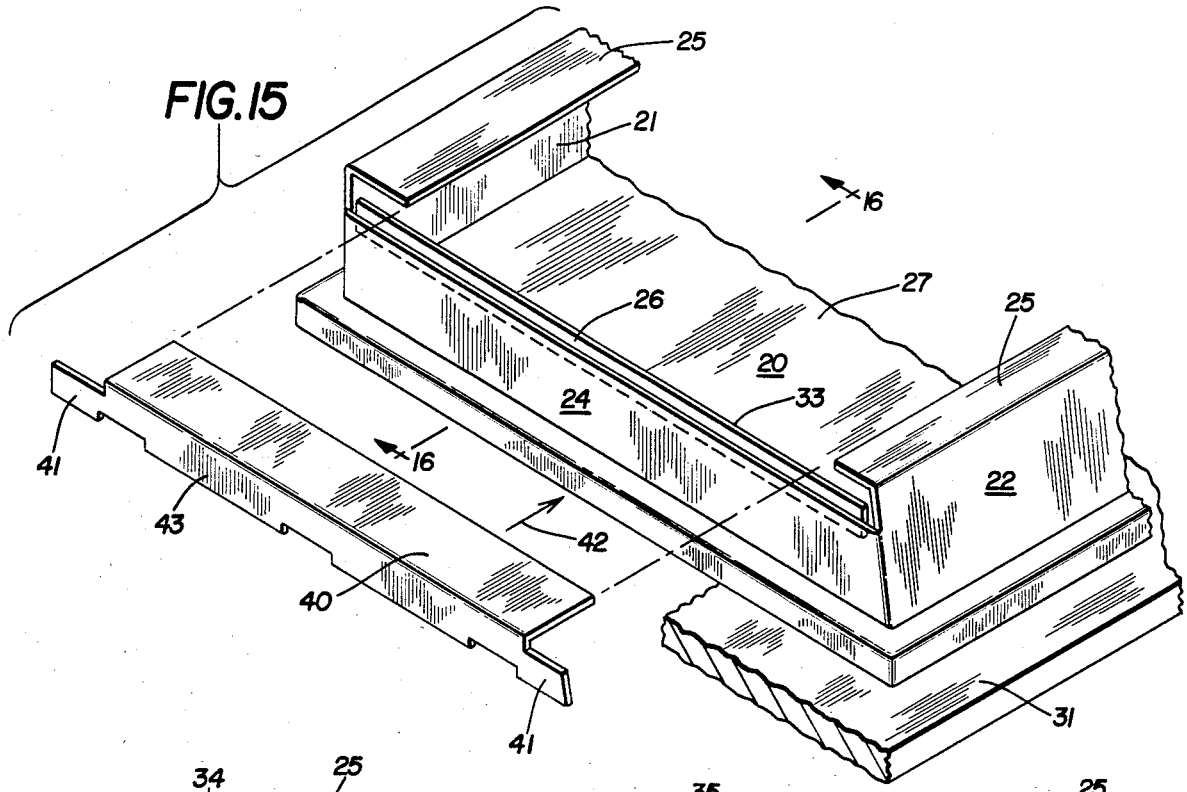
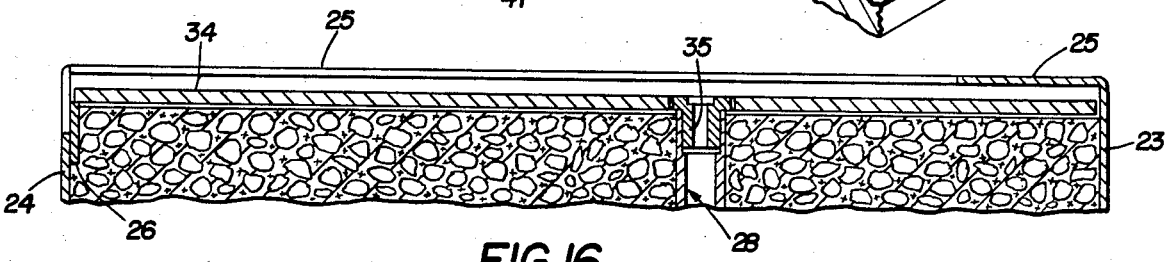
FIG.16
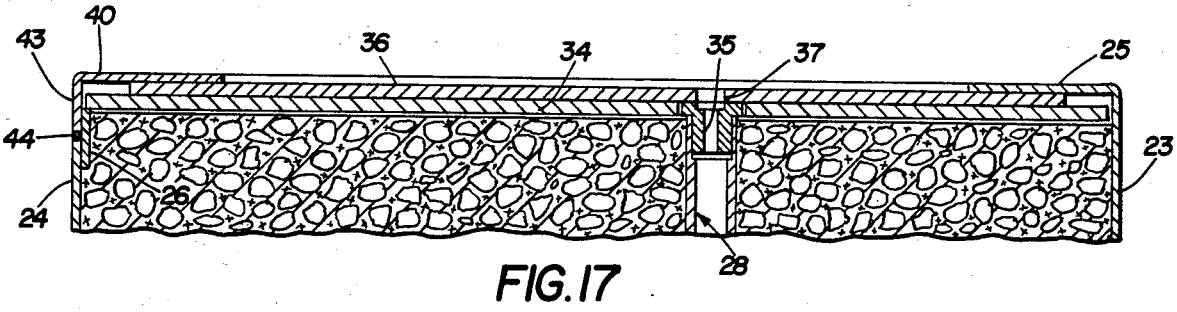
FIG.17
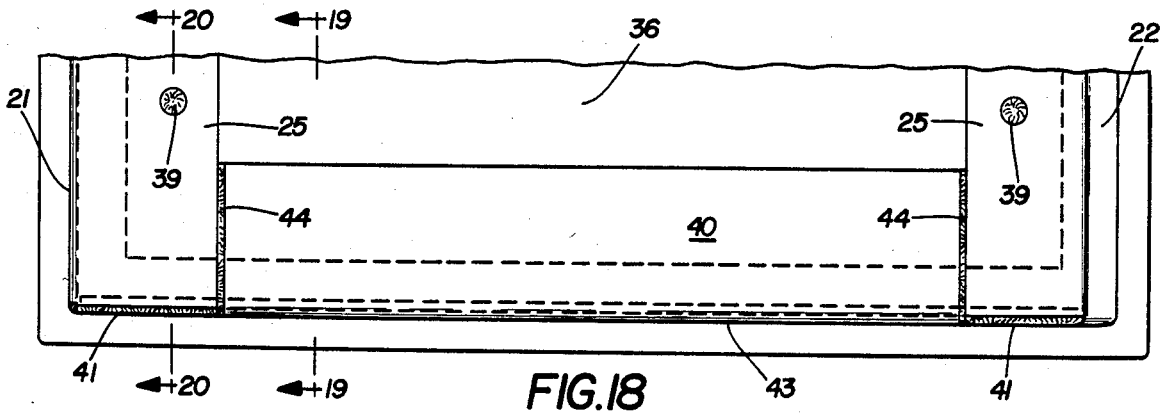
FIG.18

BURGLARY ATTACK RESISTANT MONEY SAFE HIGH FIBER CONCRETE REINFORCED METAL ENCASED WALL AND DOOR CONSTRUCTION AND MANUFACTURE

BACKGROUND OF THE INVENTION

1. Field of the Invention

The invention relates to security enclusures or products such as money safes and the like having body wall and door construction providing barriers resistant to forced entry attack by cutting torches, power drills, impact hammers, abrasive cutting wheels, power saws, carbide drills, and other tools or pressure applying devices.

More particularly the invention relates to providing money safes and the like with metal encased homogeneous monolithic fractured aggregate and metal fiber reinforced concrete body and door walls.

Further, the invention relates to providing a new forced entry attack resistant money safe body and door wall construction and especially new methods of manufacture of such safe walls to replace prior safe body and door walls having layers of torch and tool resistant plates in the cavities of the safe body and door walls heretofore used to meet Underwriters' requirements for such products.

2. Description of the Prior Art

Traditionally, safe body and door walls have been built with the desired thickness to obtain the degree of security required. Such walls essentially are solid slabs formed of joined together layers of various metals, alloys or materials required to resist the various attack measures which might be used directly on the walls in an attempt to gain access to the interior of the safe. An example of such multi-plate wall security construction is shown in this Assignee's previous Graber U.S. Pat. No. 3,110,271.

Underwriters' Specifications classify a safe wall as failing to be burglary resistant if a 2 square inch opening may be formed through the wall by 30 man-minutes of working time of the attacker or attackers.

Multi-plate security walls for security safe body and door walls of the type shown in said U.S. Pat. No. 3,110,271 are difficult and expensive to manufacture. Such multi-plate construction has security weakness in areas or zones, particularly corner zones and where plate seams, splices or joints are required. These weak zones do not have the same level of protection as the main multi-plate body. Such weak zones are known to intruder and frequently are locations of attack.

For many years efforts have been exerted in the field of security products to find an alternate form of protection that would be less expensive and easier to build than the traditional multi-plate protection, and which would provide at least equivalent security characteristics against all known type and means of attack.

Developments in the field of metal fiber reinforced concrete were examined and explored, such as the concrete overlay construction of U.S. Pat. No. 4,339,289, and metal fiber reinforced refractory concrete shapes used in the steel industry for plunging bells, injection lances or pier blocks of U.S. Pat. No. 4,366,255.

However, such improved prior metal fiber reinforced concrete overlay and refractory products and procedures for their manufacture are not adapted to be used, as such, to provide safe wall security barriers with the required degree of attack resistance against the formation of attack openings through safe body and door walls, and having security characteristics at least equivalent to said traditional multi-plate protection.

Further, we have discovered that metal fiber reinforced safe wall security barriers should contain a combination of relatively high percentages by volume of both metal fibers and relatively large sized ceramic aggregate phases as the concrete phase reinforcement to achieve such required degree of attack resistance at least the equivalent to that provided by said traditional multi-plate protection.

It was found difficult if not impossible, to mix such high fiber-aggregate content reinforced concrete formulation in a typical concrete mixer and to introduce the same into the body and door wall cavities of a safe.

These difficulties relate primarily to the special configurations of the cavities in safe body and door walls in which the high fiber-aggregate content reinforced concrete formulation is to be cast; to the necessity of positioning copper plates at particular locations or zones in the safe wall cavities; to the fact that the barriers, including copper plates, must be cast and completely encased in wall cavities formed by metal shell walls that ultimately form the metal encasement for the barriers; and to the necessity of providing an access opening initially in the shell walls through which the cavities are filled and to then closing such access openings.

For example, the safe body cavity formed by metal encasing shell walls has five cavity portions, namely, two side wall cavity portions, a back wall cavity portion and top and bottom cavity wall portions. Further, these cavity portions are connected together and the protective barrier formed in the connected cavity portions should be a homogeneous monolithic substructure free of zones of weakness, such as zones of weakness heretofore present in the described multi-plate protective prior art safe walls.

Also, different manners of handling the safe body and door walls are used in forming the barrier in the five sided safe body component on the one hand, and in forming the barrier in the substantially rectangular flat door component on the other hand. Also, the positioning of copper plate elements in the body and door cavities require different procedures.

Further, different procedures must be used for completing the metal encasement of the cast barrier in the body on the one hand, and for completing the metal encasement of the cast barrier in the door on the other hand.

Although some prior art concrete security wall structures have been proposed for safes, such as described in U.S. Pat. No. 4,377,977, such prior structures apparently do not have attack resistant characteristics like those provided by the new reinforced concrete wall structure for the body and door components of a money safe of the invention wherein copper members become an integral part of or cooperate with the new fiber and aggregate reinforced concrete structure.

Accordingly, there has existed in the art a long-standing need for a barrier construction effective to resist burglary attack upon safe body and door walls, which would be less expensive than, and have at least equivalent attack resistance characteristics to those of the traditional multi-plate security protective safe body and door wall constructions of the prior art.

The new high fiber-aggregate content reinforced concrete formulation of the present invention, and the discoveries of new procedures by which such reinforced concrete formulation may be cast in safe body and door walls to avoid or satisfy the difficulties described, provide answers to said long-standing need that has existed in the art.

SUMMARY OF THE INVENTION

Objectives of the invention include providing a new barrier construction resistant to forced entry attack of known types used by intruders to gain access within a predetermined time period to the interior of a safe having body and door walls protected by such barrier construction; providing such new barrier construction having a special metal fiber-aggregate reinforced concrete formulation cooperatively combined in certain zones with copper elements, all located in a five-sided body wall cavity and in a door cavity, each of which cavities is formed by metal shell walls or sheaths completely encasing the protective barrier; providing such new barrier construction in which the special metal fiber reinforced concrete formulation includes fractured, unmulled, nontumbled alumina having a maximum dimension of ⅝" to 4", and preferably 1" to 2"; providing a new method of casting such metal fiber reinforced concrete wherein the body and door cavities containing such barrier construction are initially entirely filled through a sheath opening with the desired proportions of metal fibers and alumina aggregate, and then are filled with a liquid slurry of hydraulic cement to completely infiltrate, inundate and cover the previously filled metal fibers and aggregate, and wherein the metal sheath cavity-forming walls in which such concrete is cast, after the concrete has set, has a metal closure wall for the sheath opening engaged with the cavity-forming sheath walls for each cavity to completely encase the protective barrier construction cast in such cavities; providing such new method in which the copper plate components of the barrier are placed in proper location in body wall cavities before filling the cavities with metal fibers and aggregate, and are placed in the door cavity after completion of the casting and curing of the concrete barrier components in the door cavity; providing such new method in which the opening means formed in the safe body cavity forming shell walls has a top opening with inturned flanges which act as a fill level gauge, and in which the opening means formed in the door cavity forming shell walls has top inturned flanges on three sides and an edge opening along the fourth side of the top opening and in which the edge opening acts as a fill level gauge; providing such new method in which said body top opening is closed by a metal plate laid onto said inturned top opening flanges and is welded thereto, and in which after the concrete barrier element is cast and cured in the door cavity the copper plate is slidably moved through said door shell wall edge opening along with a metal shell opening closure plate beneath said three inturned door shell opening flanges, and then said metal closure plate is bolted and welded to said three inturned flanges, and then the edge opening is closed by an angular end-flap-containing closure element welded to said closure plate; and providing such new metal encased forced entry resistant barrier construction for safe body and door walls and such new methods of incorporating such forced entry resistant barriers in such safe walls which may be carried out using readily controlled and reliable procedures, and which barrier construction and its manufacture satisfy the indicated objectives and long-standing wants existing in the field of security products.

These and other objectives and advantages may be obtained by a security enclosure or product such as a money safe having body and door walls protected by a barrier which may be described in general terms as a burglary attack resistant composite material barrier for security product walls comprising a concrete phase reinforced with metal fiber and ceramic aggregate phases, having a metal fiber phase of 5% to 10% by volume, a concrete phase containing hydraulic cement, and a ceramic aggregate phase having a maximum particle size of ⅝" to 4".

These objectives and advantages also may be obtained by the method of casting a burglary attack resistant metal fiber and ceramic aggregate reinforced concrete barrier composite in a body or door wall cavity of a safe or vault formed by metal shell plates, which includes the steps of connecting metal shell plates together to form a cavity for the barrier; providing an opening in the shell plates communicating with said cavity; introducing a mixture of ceramic aggregate and steel fiber phase constituents of a barrier forming composite through said opening into said cavity to completely fill said cavity to said opening; mixing a slurry of hydraulic cement and water and introducing said slurry as the concrete phase of said composite into said cavity to infiltrate, inundate and submerge said fibers and aggregate and to fill said cavity to said opening; permitting the filled constituent phases of said composite to cure as a reinforced concrete barrier; then closing said opening with a metal shell plate to encase the barrier; and providing said constituent phases in volume percent proportions of 50–70 concrete phase, 25–40 ceramic aggregate phase, and 50–70 steel fiber phase.

BRIEF DESCRIPTION OF THE DRAWINGS

Preferred embodiments of facets of the invention—illustrative of the best modes in which applicants have contemplated applying the principles—are set forth in the following description and shown in the drawings, and are particularly and distinctly pointed out and set forth in the appended product and method claims.

FIG. 1 is a diagrammatic perspective view of a money safe having walls and a door provided with the new burglary attack resistant barrier;

FIGS. 5, 6, 7 and 8 are single line diagrammatic views of the safe body metal shell, illustrating stages in casting the concrete barrier in the shell cavity and finally closing the cavity, in accordance with the invention;

FIG. 9 is an enlarged fragmentary veiw of a corner of the body back wall looking in the direction of the arrows 9—9, FIG. 8, illustrating the manner in which the body cavity is closed after casting the barrier in the cavity;

FIG. 10 is a fragmentary sectional view looking in the direction of the arrows 10—10, FIG. 9;

FIG. 15 is an exploded fragmentary perspective view of certain of the door components before assembly;

FIG. 16 is a fragmentary sectional view of the door after the barrier has been cast therein, looking in the direction of the arrows 16—16, FIG. 15, illustrating the manner in which a copper plate protective element is incorporated in the door barrier;

FIG. 17 is a view similar to FIG. 16 showing a further stage of enclosing the barrier in the door;

FIG. 18 is a fragmentary view of the lower end of the door looking toward the door back wall in the direction of the arrows 18—18, FIG. 12;

Similar numerals refer to similar parts throughout the various figures of the drawings.

DESCRIPTION OF THE PREFERRED EMBODIMENTS, PRODUCT AND METHOD

Figure 2:
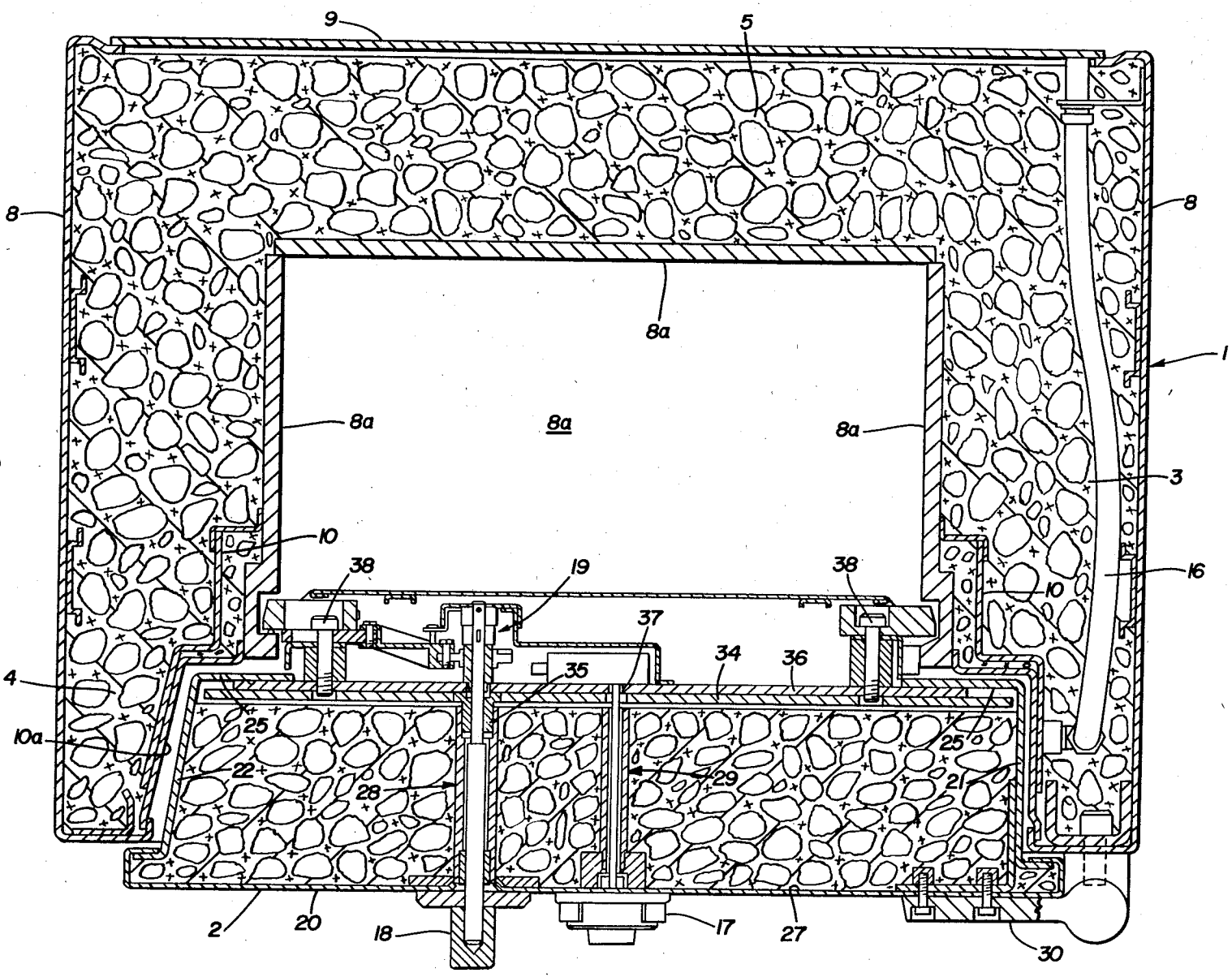
FIG. 2 is an elnarged plan sectional view of the safe taken on the line 2—2, FIG. 1.

An example of the formulation of a high fiber reinforced concrete that, when encased in cavities defined by steel shell walls to form the body and door of a money safe, provides burglary attack resistance characteristics at least equivalent to those provided by traditional multi-plate security protected safe body and door walls, is set forth in the following:

TABLE I

| Constituent | lb/yd$^3$ |
|---|---|
| Type III Portland Cement | 824 |
| Water | 457 |
| Steel Fiber (0.016 × 0.75 in. Duoform) | 831 |
| Fused Alumina Aggregate (1 to 2 in. maximum size) | 1906 |
| Superplasticizing Admixture (Melamine-formaldehyde type) | 93 |

The particular materials constituting the constituents of the steel fiber reinforced concrete are those preferred in accordance with the invention. Certain possible equivalent materials are described below as well as preferred ranges within which the indicated compositional constituents may be varied, depending upon the degree of protection desired, and the wall thicknesses involved.

The indicated compositional requirements of an attack resistant steel fiber reinforced concrete barrier of the invention, presented seemingly insurmountable difficulties in casting the concrete within safe wall and door cavities wherein copper plates are required to be present in order to provide the necessary attack resistance in certain zones where special conditions exist that frequently are the locations where intruders may initially attempt attack measures.

We have discovered basic procedures that may be carried out, in some instances specifically different in the order of steps, by which the seemingly insurmountable difficulties may be overcome in casting the new steel fiber reinforced concrete composite in the five connected cavity wall portions of the safe body, and in the safe door cavity portion, which procedures are described in detail below.

A money safe having walls and a door to be protected by the new barrier composite is generally indicated at 1. The safe has a door 2 and a body composed of side walls 3 and 4, a back wall 5 and top and bottom walls 6 and 7. The various body walls each have cavities defined by metal shell or sheath plates generally indicated at 8. These shell plates ordinarily are formed of 11 gauge (0.1196") mild or low carbon steel. In some instances some of the plates may be heavier gauge steel, such as the plates 8*a* forming the interior of the safe compartment. Such cavity forming shell plates 8 and 8*a*, excepting back wall plate 9, are welded together in a known manner to form the various body wall cavities in said side, back, top and bottom walls 3 to 7 of the safe.

These five body wall cavities are connected together and act as a mold to receive the attack resistant barriers. Prior safe construction as shown, for example, in said U.S. Pat. No. 3,110,271, have similar cavities which contain the known multi-plate arrangement to form the barriers. Such multi-plate protective barriers have included copper plates in certain zones where attack by torches usually occurs. The copper in these zones dissipates the heat rapidly enough to provide the required attack resistance.

Thus, copper plates must be present at such known zones of attack in the body walls containing the new protective barriers of the invention. Such copper plates are indicated at 10 in FIGS. 2 and 3 surrounding the doorway opening 10*a* of the safe body.

Figure 3:
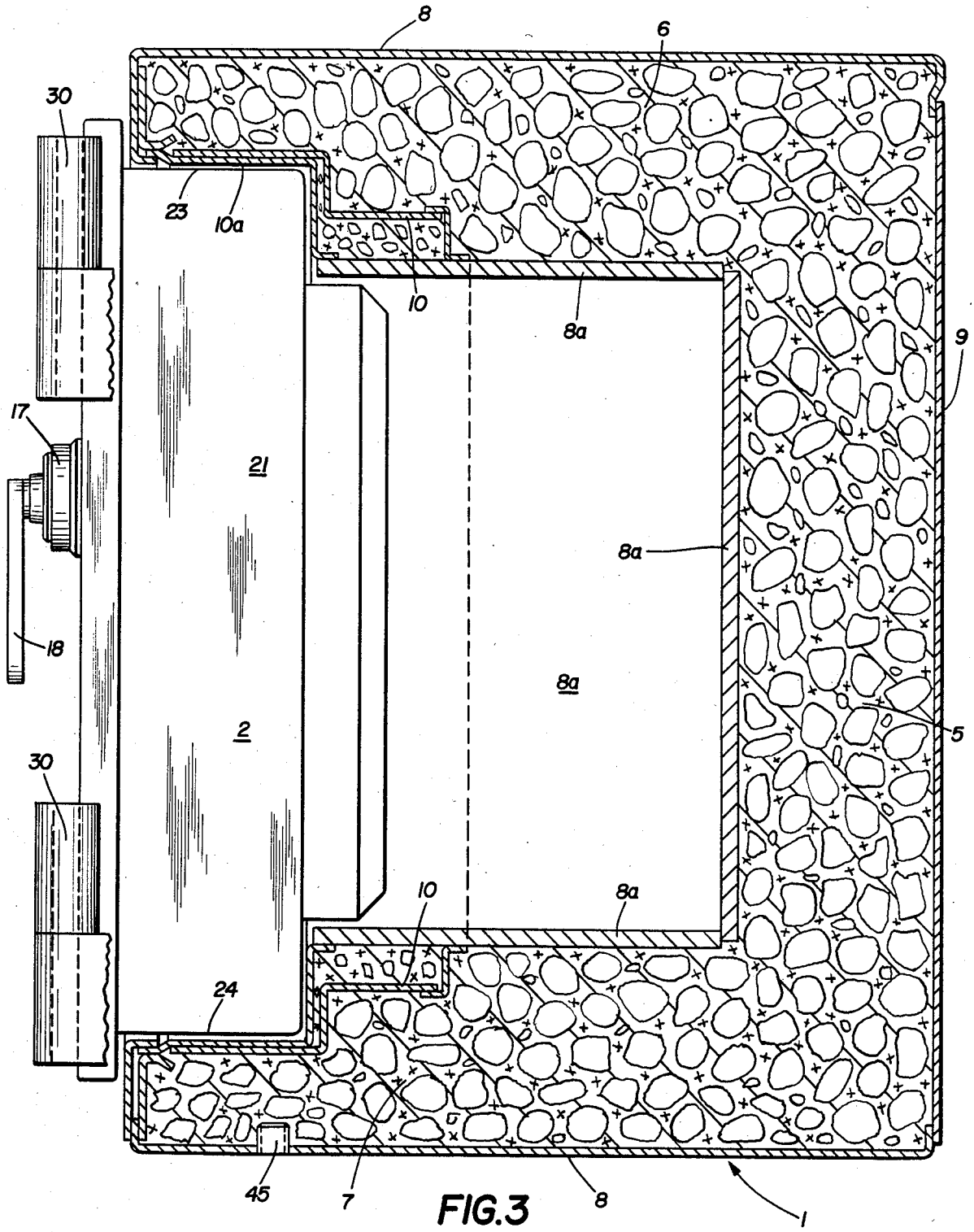
FIG. 3 is an enlarged vertical sectional view of the safe taken on the line 3—3, FIG. 1 showing the safe top, bottom and back walls in section and the door in full lines.
Figure 19:
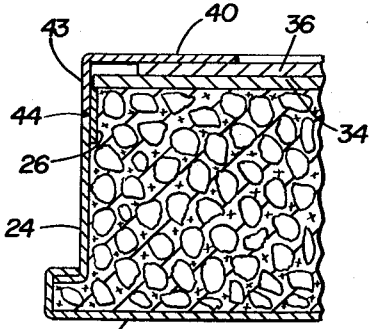
FIG. 19 is a fragmentary sectional view taken on the line 19—19, FIG. 18.
Figure 20:
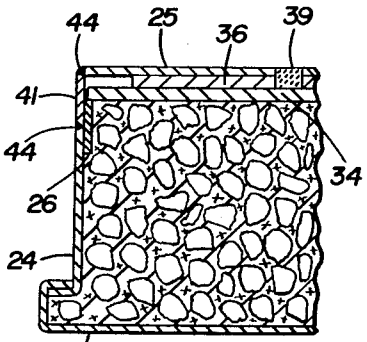
FIG. 20 is a fragmentary sectional view taken on the line 20—20, FIG. 18.

In accordance with the invention, the safe body sheath plates are welded together as shown in FIGS. 2 and 3 except for the back wall plate 9. The formed body shell is diagrammatically shown at A with single lines in FIGS. 5 through 8. Body shell A is turned so that its front portion containing the doorway 10*a* rests on a support surface 11 in a position wherein the back wall with an opening 12 is presented at the top of the body, as shown in FIG. 5.

Steel fibers are fed by a belt conveyor to the opening 12 while alumina aggregate is dropped on the steel fibers being conveyed by the belt, in the furmulation proportions, so that a mixture of steel fibers and alumina aggregate fills the side, top and bottom wall cavities of the body shell A, and finally fills the back wall cavity to a general level defined by the recessed flanges 13 which define the back wall opening 12 (FIGS. 5 and 6).

At this time, the steel fibers and fractured aggregate are roughly smoothed to present a top fill level area just below the flanges 13. In this manner, the steel fiber and ceramic aggregate phases, which form the concrete reinforcement, completely fill and are packed generally uniformly in the interconnected five body wall cavities of the safe.

Such a filling procedure of body wall cavities with the fiber and aggregate reinforcing phases of the barrier can be carried out by hand. However, the belt conveyor filling procedure is preferred since it can be readily carried out as a production procedure using known belt conveyors in the manner described.

The alumina in the form of fractured unmulled and tumbled material and in the form and sizes of pieces indicated, comprise chunks that are fractured from a larger body with rough and sharp fractured edges that become intimately and cohesively interengaged with the randomly oriented steel fibers which provides a compact mixture in the cavities wherein the concrete is to be cast. The fractured alumina constitutes the ceramic aggregate phase of the concrete.

At this time a readily flowable slurry is formed of the cement, water and superplasticizing admixture constituents of the formulation. Normally, at very low water-cement ratios, cement/water slurries will be very viscous. In the present case, the slurry would be too viscous to penetrate and fill the spaces around the compact mass of fibers and aggregate therein.

This difficulty is avoided by incorporating the admixture in forming the slurry which enables the cement constituent of the composite to be poured or pumped as a liquid into and to flow freely in the cavities which contain the compact mass of fibers and aggregate and to completely fill the cavities, as shown in FIG. 6 until the slurry reaches the level line 14 as shown in FIG. 7, gauged by the flanges 13.

The slurry infiltrates the fibers and aggregate and completely fills the body cavities to form an integrated mass connected throughout the five wall cavity portions. The mass also encompasses the copper plates 10 located around the doorway opening 10*a*. There are openings between adjacent copper plates sufficient to enable slurry flow and penetration of the barrier constituents around the copper plates.

During this slurry filling step, it is desirable at least part of the time to vibrate the support surface 11 so that the body cavities are completely filled with the slurry.

The slurry has been indicated as being poured or pumped into the cavities. This slurry-pumping may be performed to fill the cavities, viewing FIG. 7, from the bottom up to the top, by providing a coupling member 45 in the cavity of the bottom wall 7, as shown in FIG. 3. A hose may be coupled with coupling 45 for such slurry-fill-pumping. The coupling member 45 may be plugged when slurry filling has been completed.

The cement slurry thus reinforced is permitted to set up overnight, after which the back wall shell plate 9 may be laid on and supported by the recessed flanges 13, as shown in FIG. 8. Edge portions of the back plate 9 then are welded to the recessed flanges 13 at spaced intervals by plug welds 15 as shown in FIG. 9.

Referring to FIG. 2, the manner in which the steel fiber, ceramic aggregate reinforced concrete barrier is formed in the safe body cavities permits accessory devices to be located within the cavities before the barrier composite is formed. An example is the conduit 16 extending through the cavity in the side wall 3 which may contain wiring for the alarm system with which the safe may be equipped. Since the conduit 16 becomes integrated in the barrier after the barrier is cast in the safe body cavities, the barrier provides attack resistant protection for the conduit.

The procedure just described for forming the improved attack resistant barrier in the walls of the safe body as diagrammatically illustrated in FIGS. 5 through 8 results in a barrier which is completely encased with the metal shell walls which, in effect, have formed the mold within which the barrier is cast and subsequently retained.

The integrated character of the barrier throughout the five cavity portions of the safe body walls provides a homogeneous monolithic body having greater attack resistant protective characteristics than the prior multiplate barrier construction which is characterized by weaknesses at joints between plates.

Furthermore, the fractured unmulled alumina aggregate constituent or phase of the barrier distributed throughout provides enhanced resistance to drilling which is one mode of attack frequently used by intruders. Also, the alumina does not torch-out, that is burn out from a mode of attack using torches. The copper plates, provided where indicated, as in prior devices, assist in circumventing a torch mode of attack by rapidly carrying heat away from and dissipating such heat to prevent entry in the zones where the copper plates are located.

Fundamentally, the procedure for casting the improved barrier construction in the safe door 2 cavity is the same as that described for the safe body walls. However, there are detailed differences in the procedure occasioned because of door components that are mounted on or extend through the door.

Such components include the combination lock actuator means generally indicated at 17, the handle and shaft means 18 which extend through the door to actuate the door locking mechanism generally indicated at 19, and which is mounted on the inside of the door. Each of the components 17, 18 and 19 requires adjacent copper members to be provided in the door for protection against torch attack in order to convey heat away from such components when torch attack is attempted.

Figure 13:
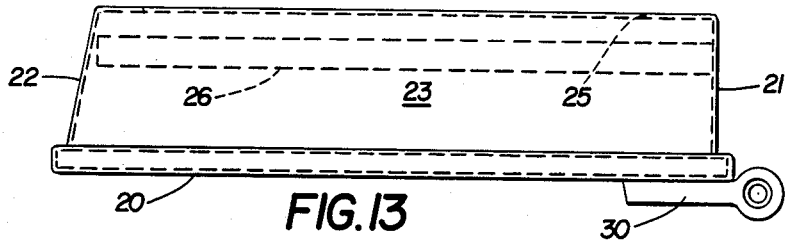
FIG. 13 is a top view of the door shown in FIG. 11 looking down on the top edge of the door.
Figure 11:
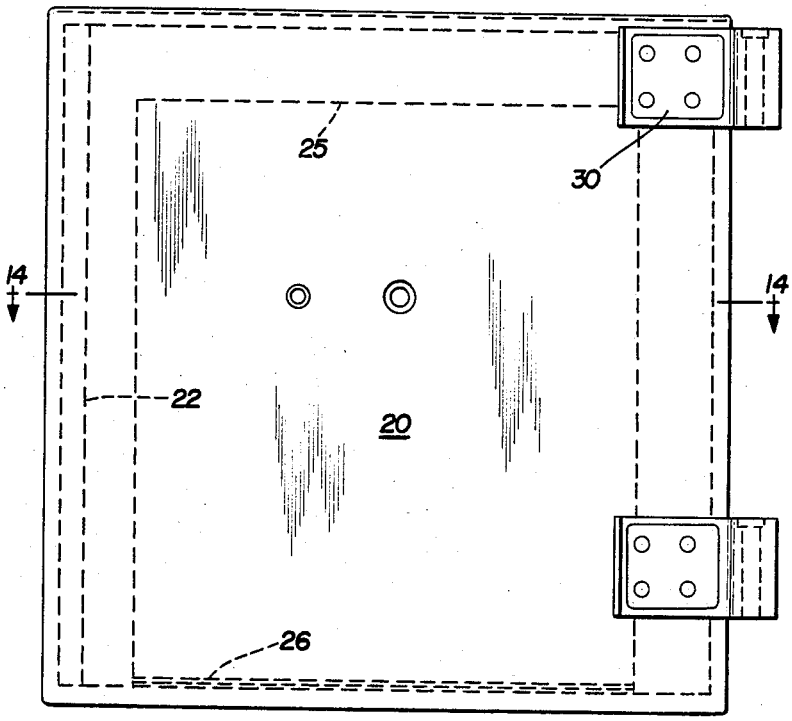
FIG. 11 is a front elevation of the safe door before being hinge-mounted on the safe body.
Figure 12:
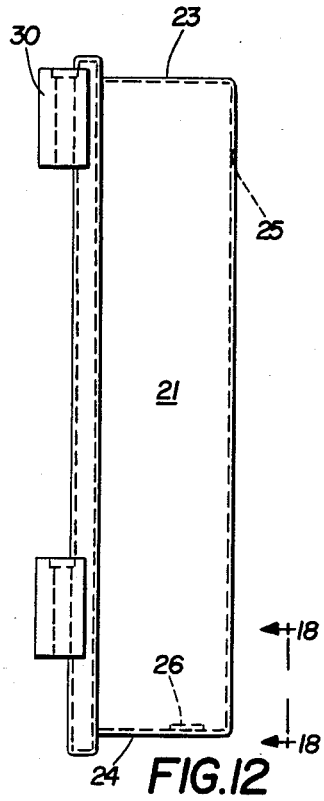
FIG. 12 is a side elevation of the door shown in FIG. 11 looking toward the right side edge of the door.

The door 2 (FIG. 2) has a metal shell formed by outer flanged steel plate 20, and hinge side edge wall plate 21, tapered side edge wall plate 22, a top edge wall plate 23 (FIG. 13) and a bottom edge wall plate 24.

Figure 14:
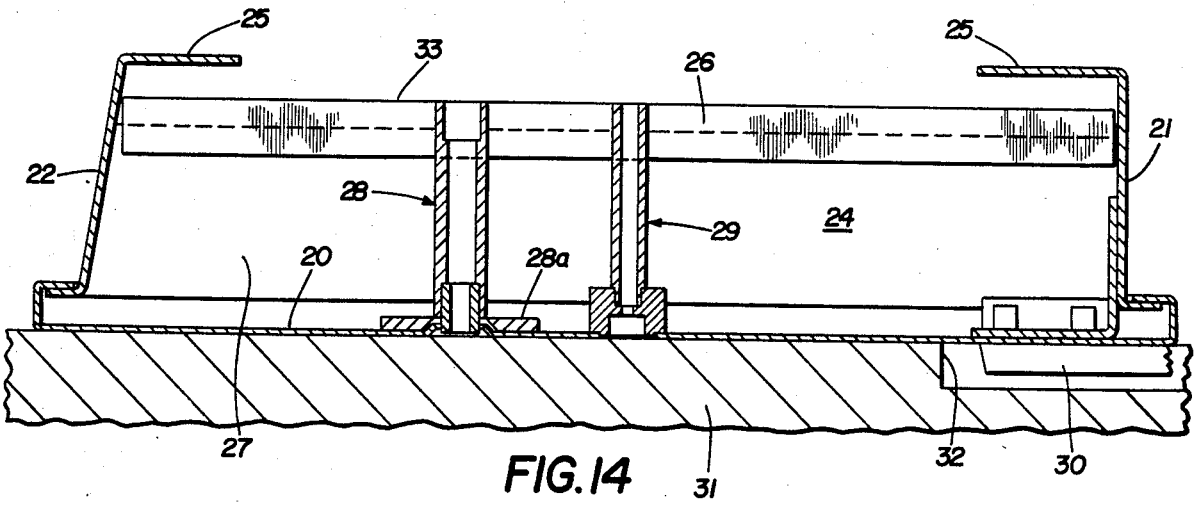
FIG. 14 is a sectional view taken on the line 14—14, FIG. 11 showing the door shell or sheath forming the door cavity in which the burglary attack resistant barrier is to be cast.

The hinge side and tapered side plates 21 and 22 and the top wall plate 23 terminate in inturned flanges 25, while the bottom edge wall 24 terminates short of said flanges 25 as best shown in FIGS. 14 and 15. Bottom wall 24 preferably has a strip plate 26 welded to the inside thereof projecting a short distance upward toward the flanges 25 (FIGS. 14 and 15). The purpose of the strip plate 26 is described below.

The various door shell plates just described are welded together to form the door cavity 27 the lower end of which is shown in FIG. 15 and a horizontal cross-sectional shape of which is shown in FIG. 14. The door shell has the shape of a five-sided box with a top opening defined by the flanges 25 at the side and top edge plates 21, 22 and 23, when the door shell is lying with its outer wall 20 on a flat surface of a support member 31 (FIGS. 14 and 15).

Copper tubular and washerlike means 28 for the handle and shaft means 18 and copper members 29 for the combination lock actuator means 17 are mounted in fixed position on the inside of the outer door plate 20 as shown in FIG. 14 before the barrier is cast into the cavity 27.

Hinge plate members 30 at this time are mounted at the upper and lower portions of the outer door plate 20 adjacent the hinge side plates 21. Provisions must be made in the support member 31 for the door 3 when being cast so that the boxlike door can lie flat on the surface of support member 31. Thus recesses 32 are formed in the support member 31 to accommodate the hinge plates 30 (FIG. 14).

The rectangular five-sided top opening boxlike door shell resting on the support member 31 is now ready to have its fiber and aggregate reinforced concrete barrier cast therein. This is accomplished generally in the same manner described above concerning the casting of the barrier in the safe body cavities.

The proportional mixture of steel fibers and fractured alumina aggregate are fed into the door shell cavity 27 from a belt conveyor until the cavity is filled with the fiber-aggregate mixture in the proportions required by the formulation. The filling and smoothing of the fiber-aggregate phases proceeds until the level thereof approaches a short distance below the top edge 33 of the strip plate 26.

Then the liquid cement slurry is mixed as previously described and poured or pumped into the door shell cavity 27 so that the fiber-aggregate phase mixture is submerged in and completely infiltrated by the slurry until the slurry level reaches the top edge 33 of the strip plate 26 which acts as a fill level gauge.

The reinforced concrete thus cast is permitted to set up overnight and then a copper plate 34 is laterally slid beneath the shell flanges 25 and above the cast barrier to the position shown in FIG. 16. A copper flanged spool 35 is then inserted through an opening in the copper plate 34 and into the open upper end of the copper tube means 28 for the handle shaft.

Then the door shell steel back plate 36 is slidably entered in the space above the copper plate 34 and below the shell flanges 25 generally to enclose the copper plate and the opening defined by the flanges 25 on the door shell side and top plates 21, 22 and 23 (FIG. 17). The plate 36 has an opening 37 aligned with the opening in the flanged copper spool 35 as shown.

Referring to FIG. 2, at this time bolts 38 engaging members of the door lock mechanism 19 are threaded into openings previously provided in the door shell back plate 36 to mount the door lock mechanism 19 on the door and to draw the door shell back plate 36 upward against the shell flanges 25 so that the shell flanges 25 may be plug-welded at 39 to the door shell back plate 36 (FIG. 18).

Meanwhile, before the bolted connection 38 is made to mount the lock mechanism 19 on the door, a steel angle member 40 having end flaps 41 is installed as indicated by the arrow 42 (FIG. 15) to close the opening above the strip plate 26 through which the copper plate 34 and door shell back plate 36 were inserted beneath the shell flanges 25. The flaps 41 close the space below the flanges 25 and the downturned flange 43 of angle member 40 overlaps the projecting portion of strip plate 26 above the top edge of bottom door edge plate 24 so that angle member 40 may be welded as indicated generally at 44 to abutting edges of flanges 25 and angle member 40 and of flange 43 of angle member 40 and the upper edge of bottom door shell plate 24. In this manner the barrier cast in the door 2 is completely encased in its metal shell.

Figure 4:
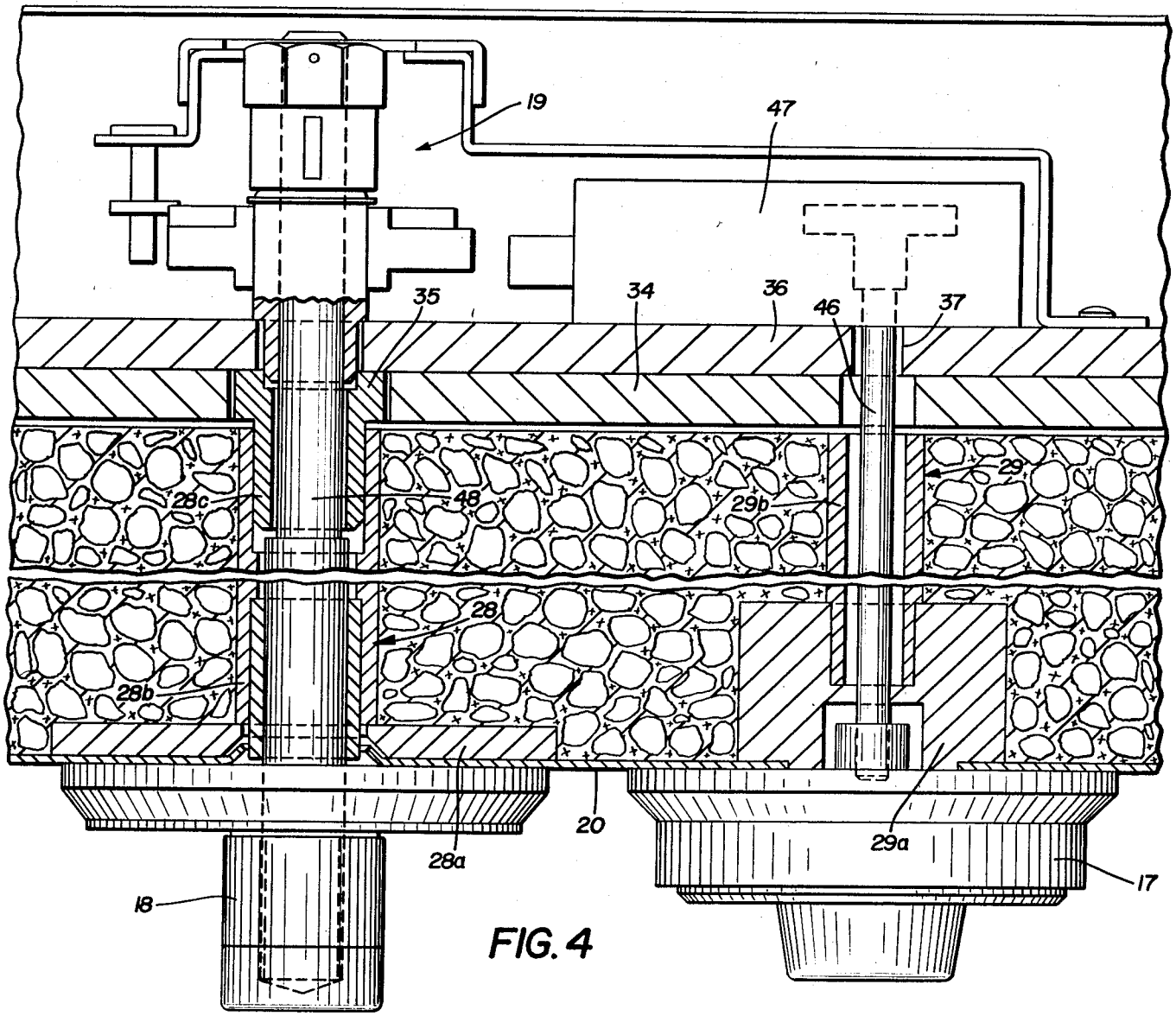
FIG. 4 is a further enlarged fragmentary sectional view looking in the direction of the arrows 4—4, FIG. 1.

The assembly of the door 2 is completed after the barrier has been cast in the door cavity 27 and has been encased completely by the shell walls as described. During casting of the barrier the copper tubular and washerlike means generally indicated at 28, and the handle shaft copper means members generally indicated at 29, which were located in the cavity 27, as shown in FIG. 14, become encased in and by the concrete barrier as shown in FIG. 4.

The copper protective means 28 for the handle means 18 includes a washerlike member 28*a*, a tubular member 28*b* and a thimble 28*c*. The copper means 29 for the combination lock actuator means 17 comprises a large thick ring 29*a* and a tubular sleeve 29*b*. The combination lock actuator means 17 then is assembled with the door 2 by inserting its small diameter shaft 46 through the copper ring and sleeve assembly 29*a–b*, and then connecting it to a typical combination lock 47 which is mounted on the inside of the door 2.

The cross-sectional area of the passage through the copper tubular sleeve 29*b* is considerably less than 2 square inches, and thus satisfies Underwriters' requirements.

If attack measures include pulling the lock actuator 17 and its shaft 46 out of the door, any attempt to gain access through the small diameter opening in the copper sleeve 29*b*, which extends through the door, by torching, will fail because the copper members 29*a–b* and including the copper plate 34 will dissipate the heat from the torch more rapidly than the torch can generate heat at the small tip of a torch within the tubular sleeve 29*b*.

The door handle generally indicated at 18 (FIG. 4) has an actuating shaft 48 formed of stainless steel inserted through the copper washer, tube and thimble assembly 28*–b–c* and connected to the door lock mechanism. The door handle shaft 48 ordinarily may have a larger diameter cross-sectional area than 2 square inches. This provides sufficient strength to prevent its being pried quickly out of the door, or being severed at its outer end. If so severed by some means of attack, and it is attempted to burn the stainless steel shaft 48 out of the copper members which surround it, the heat required to deteriorate the stainless steel is greater than the torch tip can stand and the torch tip is destroyed along its length. Meanwhile the heat generated is carried away by the copper protective means 28.

After the complete assembly of the door components, the door 2 may be hung on its hinge plates 30. The safe, when the door is closed and locked, has the required degree of forced entry attack resistant characteristics provided by the new barrier construction in the safe body and door walls. Such attack resistance is equivalent to or greater than that heretofore provided by the prior art multi-plate protective means, and also satisfies Underwriters' requirements.

In General

A preferred formulation of the constituents of the attack resistant reinforced concrete barrier of the invention is set forth in Table I. The range in relative proportions of the three principal phases in the composite is set forth in the following:

TABLE II

| Constituent | Volume Percent |
|---|---|
| Concrete Phase | 50–70 |
| Ceramic Aggregate Phase | 25–40 |
| Steel Fiber phase | 5–10 |

The hydraulic cement component of the concrete phase of the formulation is indicated as Portland Cement in Table I. However, other inorganic cements also could be used in the composite.

The preferred Ceramic Aggregate Phase is indicated in Table I as being fused alumina ($Al_2O_3$). However, flint, a hard form of $SiO_2$ in fractured fragments, as well as fractured fragments of fused oxides or carbides may be used.

The preferred alumina is extremely hard, but not brittle to a point where attack by an impact hammer will break it out of the concrete. It has good thermal qualities to resist cutting torch attack. The size of the fractured alumina aggregate is preferred to be from 1" to 2" maximum dimension although ⅝" up to 3" material has been successfully used. There appears to be no reason that even larger sized aggregate up to a maximum size of around 4" cannot be successfully used.

The steel fiber phase of the formulation given in Table I indicates a fiber size that has been used. The metal indicated is steel and the steel fibers indicated are a commodity on the market. They may also be formed of stainless steel. Pieces may be cut or trimmed from steel plates or wire, so that the fibers may be round or square or rectangular in cross section having the desired length or assortment of lengths. Thus, the fiber size may also be (0.016×1.0").

One other characteristic of the formulation of the barrier composite of the invention which uses minimal water is that when the slurry is introduced into the wall cavities it self-levels and when cured has zero slump.

Accordingly, new aspects of the invention include providing a homogeneous money safe wall and door barrier construction which resists burglary attacks as outlined in Underwriters Laboratory Standard 687 (Burglary Resistant Safes) Section 2.3 for TRTL-30X6 classification.

Another aspect of the invention is the advantageous result that characterizes the barrier construction wherein attack resistance is obtained at reduced cost with at least equivalent strength and protection against all known forms of attack, and particularly attack by impact hammers, torches, abrasive cutting wheels, power saws, electric power drills, carbide drills, pressure applying devices, and common hand tools.

Accordingly, the concepts of the various aspects of the invention described in detail provide a new barrier product for safes, vault doors and the like and new methods of casting the described reinforced concrete barriers in wall cavities of different sizes, shapes and number of cavities, which achieve the stated objectives, eliminate difficulties that have characterized the prior art, and solve long-standing problems, and obtain the described new results.

In the foregoing description certain terms have been used for brevity, clearness and understanding, but no unnecessary limitations are to be implied therefrom, beyond the requirements of the prior art, because such terms are used for descriptive purposes and are intended to be broadly construed.

Moreover, the description and illustration of the invention are by way of example, and the scope of the invention is not limited to the exact details shown or described.

Having now described the features, discoveries and principles of the invention, the manner in which the barrier is constructed and formulated, and the advantageous, new and useful results obtained, the new and useful structures, devices, elements, arrangements, compositions, methods, procedures and steps are set forth in the appended claims.

We claim:

1. A burglary resistant safe enclosure comprising a plurality of walls; a compartment within said walls; and an opening for access to said compartment through said walls; wherein said walls are comprised of a composite material having a concrete phase reinforced with metal fiber and ceramic aggregate phases, said material having a metal fiber phase of 5% to 10% by volume, a concrete phase consisting essentially of Portland cement, water and superplasticizing admixture, and a ceramic aggregate phase having a maximum particle size of 1½" to 4".

2. The enclosure of claim 1 in which the ceramic aggregate phase is 25% to 40% by volume.

3. The enclosure of claim 2 in which the metal fibers are steel fibers and in which the concrete phase is 50% to 70% by volume.

4. The enclosure of claim 1 in which the ceramic aggregate is aluminum oxide.

5. The enclosure of claim 4 in which the aluminum oxide is fractured, unmulled, nontumble particles of fused aluminum oxide.

6. The enclosure of claim 5 in which the fractured aluminum oxide particles have a maximum particle size of about 1" to 2".

7. The enclosure of claim 5 in which the barrier is encased in a sheet metal shell which forms a cavity in which the concrete is cast.

8. The enclosure of claim 7 in which said shell is formed of steel plates.

9. The enclosure of claim 8 in which copper plate material forms a barrier element in said shell cavity.

10. The enclosure of claim 9 in which the security product shell is a part of a safe body or door wall.

11. The enclosure of claim 1 in which the ceramic aggregate is one of the class consisting of fused oxides and carbides.

12. The enclosure of claim 1 in which the ceramic aggregate is flint.

13. The enclosure according to claim 1 and further comprising door means for closing said opening, said door means comprised of a composite material having a concrete phase reinforced with metal fiber and ceramic aggregate phases, said material having a metal fiber phase of 5% to 10% by volume, a concrete phase consisting essentially of Portland cement, water and superplasticizing admixture, and a ceramic aggregate phase having a maximum particle size of 1½" to 4".

* * * * *